United States Patent [19]

Westerman

[11] 4,196,436

[45] Apr. 1, 1980

[54] DIFFERENTIAL BACKLOBE ANTENNA ARRAY

[75] Inventor: Charles W. Westerman, El Toro, Calif.

[73] Assignee: Ford Motor Company, Dearborn, Mich.

[21] Appl. No.: 960,689

[22] Filed: Nov. 14, 1978

[51] Int. Cl.[2] ..... H01Q 3/26

[52] U.S. Cl. ..... 343/854; 343/100 LE; 343/100 SA; 343/770

[58] Field of Search ..... 343/854, 853, 100 LE, 343/754, 846, 700 MS, 100 SA, 770, 771

[56] References Cited

U.S. PATENT DOCUMENTS

| | | | |
|---|---|---|---|
| 3,175,156 | 3/1965 | Sletten | 343/854 |
| 3,222,677 | 12/1965 | Fink | 343/854 |
| 3,396,398 | 8/1968 | Dunlavy, Jr. | 343/854 |
| 3,553,692 | 1/1971 | Drabowitch | 343/854 |
| 3,670,335 | 6/1972 | Hirsch | 343/854 |
| 3,771,163 | 11/1973 | Marinaccio | 343/854 |
| 3,925,784 | 12/1975 | Phelan | 343/854 |
| 3,971,125 | 7/1976 | Thies, Jr. | 343/854 |
| 3,981,014 | 9/1976 | Masak | 343/100 LE |
| 3,987,444 | 10/1976 | Masak et al. | 343/100 LE |
| 4,007,461 | 2/1977 | Luedtke | 343/853 |
| 4,010,474 | 3/1977 | Provencher | 343/854 |
| 4,051,474 | 9/1977 | Mack et al. | 343/756 |
| 4,054,886 | 10/1977 | Bergander et al. | 343/854 |

*Primary Examiner*—David K. Moore

*Attorney, Agent, or Firm*—Peter Abolins; Clifford L. Sadler

[57] ABSTRACT

This specification discloses an antenna system with a left antenna array having a pair of radiators and a right antenna array having a pair of radiators. The spacing of the radiators is such that one antenna array produces a positive phase backlobe and the other antenna produces a negative phase backlobe. Appropriate processing of the signals from the two antenna arrays permits exclusion of any signal received in the backlobe of the two arrays. The spacing between the radiators in one array is determined by the equation $\lambda(0.25 + x)$ and the spacing between radiators in the other array is determined by the equation $\lambda(0.25 - x)$ wherein $\lambda$ is the wavelength of an electrical signal applied to the antenna system and x is the radiator spacing differential in wavelengths.

9 Claims, 13 Drawing Figures

DIFFERENTIAL BACKLOBE ANTENNA ARRAY

BACKGROUND OF THE INVENTION

1. Field of the Invention

This invention relates to antenna arrays, and, more particular, to a particular antenna configuration wherein the radiation pattern of the antenna beam is shaped.

2. Prior Art

Artificial beam sharpening is known and can be used in conjunction with IFF (Identification Friend or Foe) interrogation antenna and in direction finding systems. Beam sharpening is an attempt to accurately control and define the volume of air space in which aircraft are being interrogated. Thus, artificial sharpening of beam patterns can eliminate ambiguity in direction finding systems and eliminate backlobe "punch through" in IFF systems as described below.

An established method of artificial beam sharpening compares the two signal levels simultaneously appearing at the sum and difference terminals of a hybrid in an antenna array capable of producing sum and difference beams. A valid response occurs only when signal processing within the interrogator-receiver unit determines that the sum beam gain exceeds the difference beam gain by a predetermined amount referred to as the sidelobe-suppression-level. Signal level comparisons which do not meet this criterion are rejected. In a well designed IFF antenna the sum beam gain is greater in the desired region of interrogation and, conversely, the difference beam gain is greater everywhere outside the desired region. When the sum beam sidelobes or backlobes exceed the difference beam sidelobes or backlobes by an amount greater than the sidelobe-suppression-level, "punch through" is said to exist and permits interrogation in undesired directions.

Punch-through can be reduced by increasing the sidelobe-suppression-level which is adjustable inside the interrogator-receiver unit; however, the volume of airspace which can be interrogated near the peak of the sum beam is also reduced, thus placing a limit on this option. Further reduction of punch-through can come from sum and difference pattern shaping.

Backlobe punch-through has been a persistent problem with the balanced array geometry typical of IFF interrogation antennas in current use due to the fore and aft symmetry of the difference pattern nulls. Past solutions to this problem have been directed toward a design perturbation which fills or shifts the difference pattern aft null without seriously disturbing the forward null position.

One known way of attempting to eliminate aft directed punch-through includes the use of an array sufficiently large to reduce aft directed radiation below −30 dB relative to forward directed radiation at both the sum and difference ports of the summing four port hybrid. This has the disadvantage of being overly large. Another prior art device for attempting to eliminate aft directed punch through utilizes auxiliary radiators directed toward the back of the array to perturb the null of the difference pattern in the aft direction. A device with such auxiliary radiators is very difficult to optimize because it is a patch work solution involving three radiating sources rather than a fundamental solution to the problem. It would be desirable to achieve beam sharpening which fundamentally solves the backlobe punch through problem without resorting to cut-and-dry design perturbations or having to use excessive sidelobe-suppression-levels. These are some of the problems this invention overcomes.

SUMMARY OF THE INVENTION

In accordance with an embodiment of this invention, rear "punch-through" problems can be eliminated and there can be formed a completely unidirectional "artificially sharpened" beam with no backlobe or sidelobe "punch-through". An antenna system in accordance with an embodiment of this invention used in conjunction with a standard four port hybrid coupler allows reception of signals along the forward axis and eliminates any signals from the back or sidelobes. The invention overcomes the backlobe reception that is present in prior art antenna systems of this type.

The invention includes two antenna arrays, each array having a pair of radiating means spaced according to one of two different equations. The spacing in one array is controlled by the equation $\lambda(0.25-x)$ and the spacing in the other array is controlled by the equation $\lambda(0.25+x)$, wherein $\lambda$ is the wavelength of a signal applied to the antenna and x is the radiating means spacing differential in wavelengths. The first equation can produce an antenna array having a generally cardioid beam pattern with a backlobe having a positive phase. The second equation can produce an antenna array also having a generally cardioid beam pattern with a backlobe having a negative phase. Because both beam patterns have backlobes with aft directed peaks, signal processing by a four port hybrid coupler can be used to substantially eliminate backlobe punch-through. In particular, the signal processing can produce a difference pattern with an aft directed peak.

BRIEF DESCRIPTION OF THE DRAWINGS

FIG. 1*a* is a partly block diagram of an antenna system in accordance with an embodiment of this invention;

FIG. 1(*c* ) is a representation of the sum pattern and the difference pattern of the antenna beam patterns produced by the antenna system of FIG. 1(*a* ) in accordance with an embodiment of this invention;

FIG. 7(*b*) is a plan view of the lower circuit board of the antenna sandwich of FIG. 7(*a*) showing the hybrid feed circuit configuration;

FIG. 9 is a graphical representation on a polar plot of azimuth vs. elevation of punch-through.

DETAILED DESCRIPTION OF THE INVENTION

Figure 1:
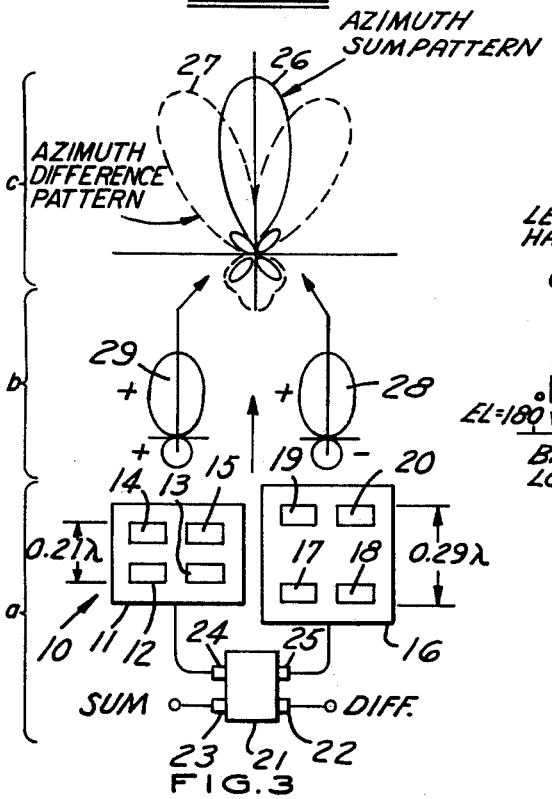
FIG. 1(*b* ) is a representation of the antenna beam pattern associated with each of the two antenna arrays in the antenna system of FIG. 1(*a* )

Referring to FIG. 1(*a*), an antenna system 10 includes a left hand array 11, a right hand array 16 and a four port hybrid coupler 21 coupled to arrays 11 and 16. Antenna system 10 is an eight slot differential backlobe array having four left hand slots 12, 13, 14 and 15 in left hand array 11 and four right hand slots 17, 18, 19 and 20 in right hand array 16. The four left hand slots 12, 13, 14 and 15 are arranged in two rows perpendicular to the forward direction spaced 0.21 wavelengths apart in a direction parallel to the forward direction and the four right hand slots 17, 18, 19 and 20 are also arranged in two rows and are spaced 0.29 wavelengths apart in a direction parallel to the forward direction. The two slots in the forward row of each half of the antenna (14, 15, 19 and 20) are excited with a phase delay equal to their respective spacings from the slots in the back row (12, 13, 17 and 18) to form forward directed, or endfire, beams having a generally cardioid sensitivity pattern with backlobes as pictured in FIG. 1(*b*). Because of the spacings chosen, the backlobe of the right hand array 16 is negative whereas the backlobe of left hand array 11 is positive with respect to the forward lobe. When the right hand pattern 28 and left hand pattern 29 are combined in the sum/difference hybrid 21, the resulting patterns observed at the output terminals of the hybrid are as pictured in FIG. 1(*c*).

Sum and difference hybrid 21 is connected to left hand array 11 and right hand array 16 by coupling a left input port 24 of hybrid 21 to left hand array 11, a right input port 25 of hybrid 21 to right hand array 16 so that a sum output port 23 produces a sum pattern 26 and a difference output port 22 produces a difference pattern 27. Sum pattern 26 exceeds the difference pattern 27 only in the forward direction so that no punch-through occurs in any other direction and interrogation and reply can take place in the forward direction. The elimination of the aft directed punch-through is made possible by the phase differential of the individual backlobes of the left hand pattern 29 and right hand pattern 28 of the array. In the aft direction, the difference pattern 27 peaks on axis and the sum pattern 26 forms a null on axis.

Figure 2:
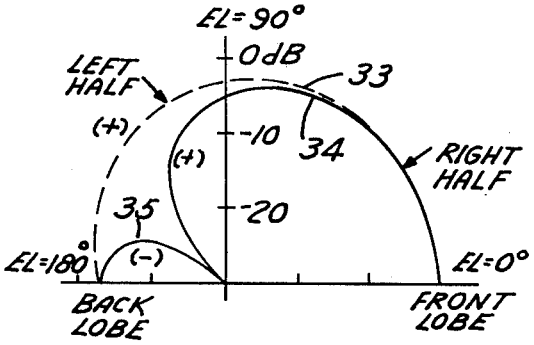
FIG. 2 is a graphical representation of the elevation patterns of the left and right hand arrays of an asymmetrical endfire array antenna system in accordance with an embodiment of this invention.

The transition from a forward peak to an aft null in the sum pattern 26 and, conversely, from a forward null to an aft peak in the difference pattern 27 can be visualized by referring to the elevation patterns shown in FIG. 2. The close-spaced slots 12, 13, 14 and 15 in the left array 11 form a single-lobed pattern 33 (dashed curve) having a greater forward gain than rearward gain, whereas the wide-spaced slots 17, 18, 19 and 20 in the right array 16 form a separate front lobe 34 and back lobe 35 (solid curve). The transition occurs at the elevation angle of the null between the front and back lobes formed by the right half of the array because of the phase reversal occurring at this point.

Figure 3:
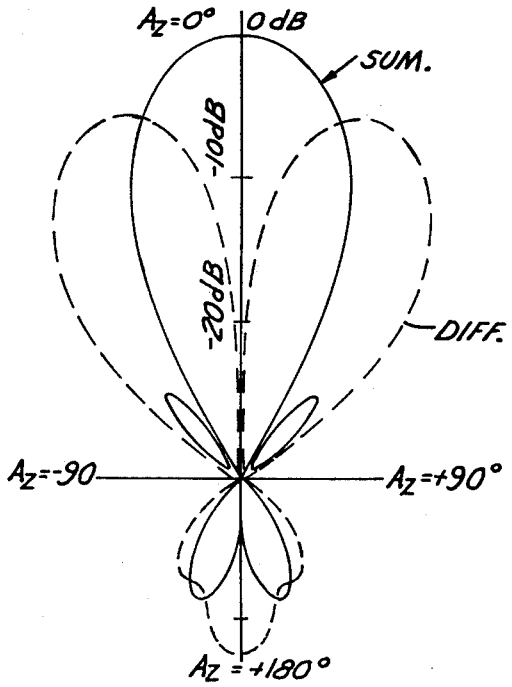
FIG. 3 is a plan view of the computed sum and difference patterns of an 8-slot asymmetrical endfire antenna array for a differential wavelength spacing (x) of 0.02.
Figure 4:
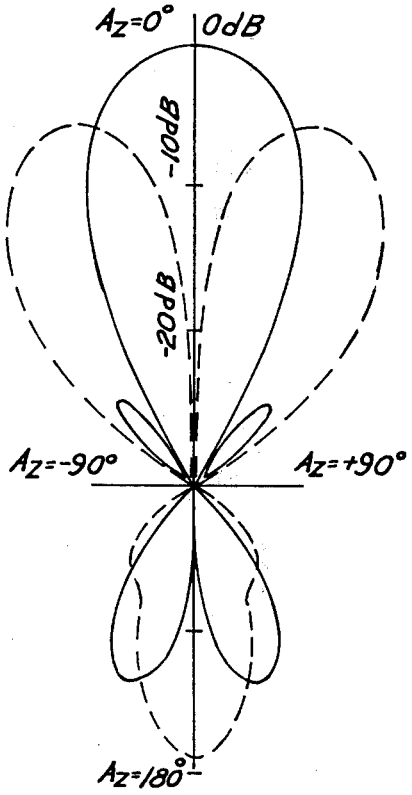
FIG. 4 is a plan view similar to FIG. 3 with x=0.04.
Figure 5:
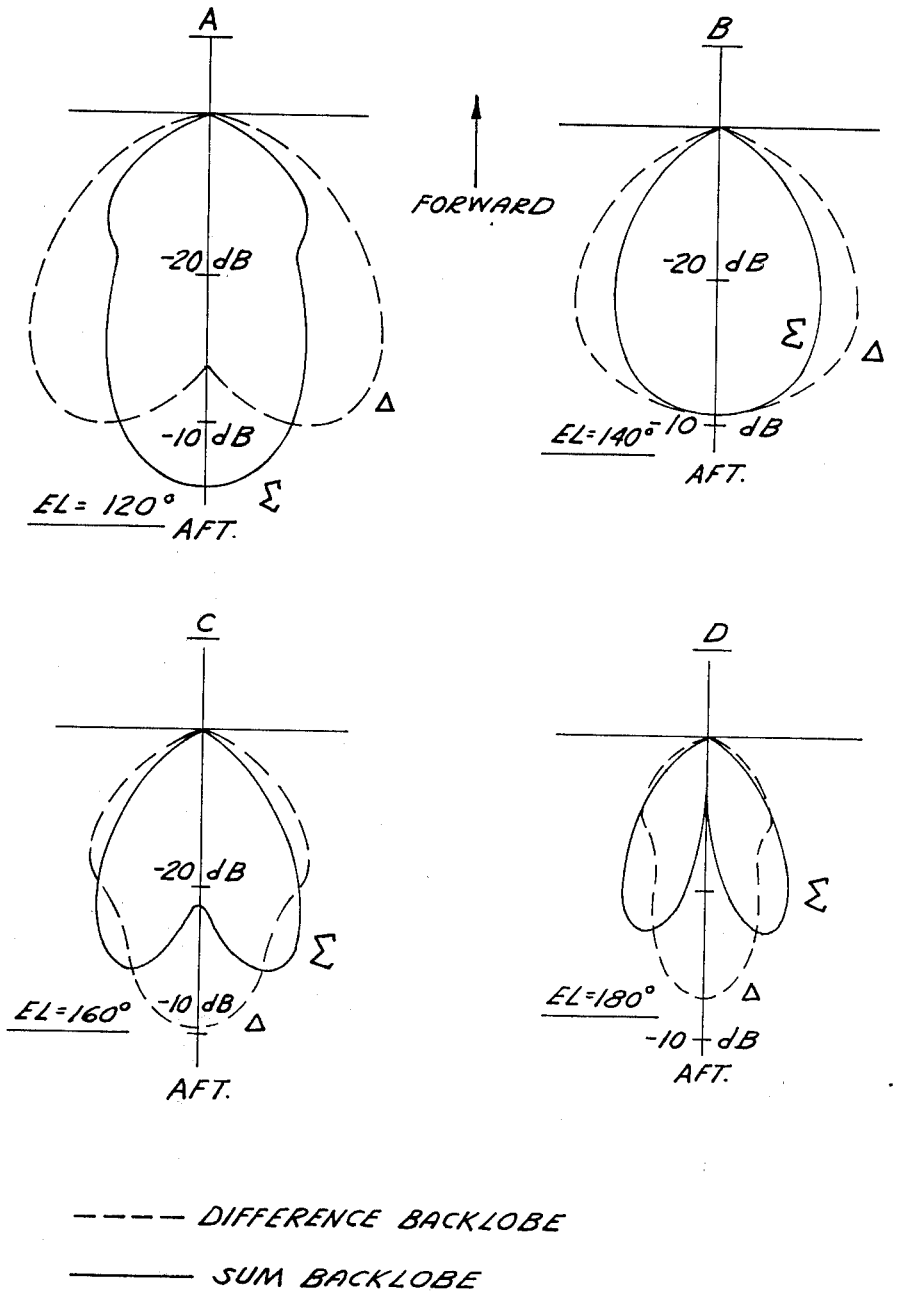
FIGS. 5*a*, 5*b*, 5*c* and 5*d* is a graphical representation of the on-axis peak to null transition region of the sum and difference backlobes versus elevation for x=0.04 at elevations of 120° in FIG. 5*a*, 140° in FIG. 5*b*, 160° in FIG. 5*c* and 180° in FIG. 5*d*.

The elevation angle at which the transition occurs can be moved forward by increasing the right hand array 16 spacing while concurrently reducing the left hand array 11 spacing by a proportionate amount according to the following relationship:

$D_L/\lambda = 0.25 - x$, and $D_R/\lambda = 0.25 + x$;

$D_L$ = Left half slot spacing in inches, $D_R$ = Right half slot spacing in inches, $\lambda$ = Wavelength in inches, x = Slot spacing differential in wavelengths Calculated sum and difference azimuth patterns for an 8-slot endfire array having an amplitude taper of 3 dB are shown for x equal to 0.02 in FIG. 3 and for x equal to 0.04 of a wavelength in FIG. 4. Freedom from backlobe punch-through requires a sidelobe-suppression-level of only 1 dB for x=0.02 of a wavelength and 5 dB for x=0.04 of a wavelength. Sidelobe-suppression-levels typically are set at much larger values to achieve the desired level of artificial beam sharpening. To achieve the desired difference of phase of the backlobe it is advantageous to have x less than about 0.25.

FIGS. 5*a*, 5*b*, 5*c* and 5*d* shows computed backlobe patterns for x=0.04 of a wavelength at several different elevation angles to illustrate the on-axis peak to null transition region. At 120° elevation from the forward main beam, the sum pattern backlobe (solid curve) exceeds the difference pattern backlobe (dashed curve) by only 8 dB. At 140° elevation, the sum and difference backlobes have equal gain, and at 160° elevation, the sum pattern backlobe has developed an on-axis null 8 dB below the difference pattern backlobe.

Figure 7:
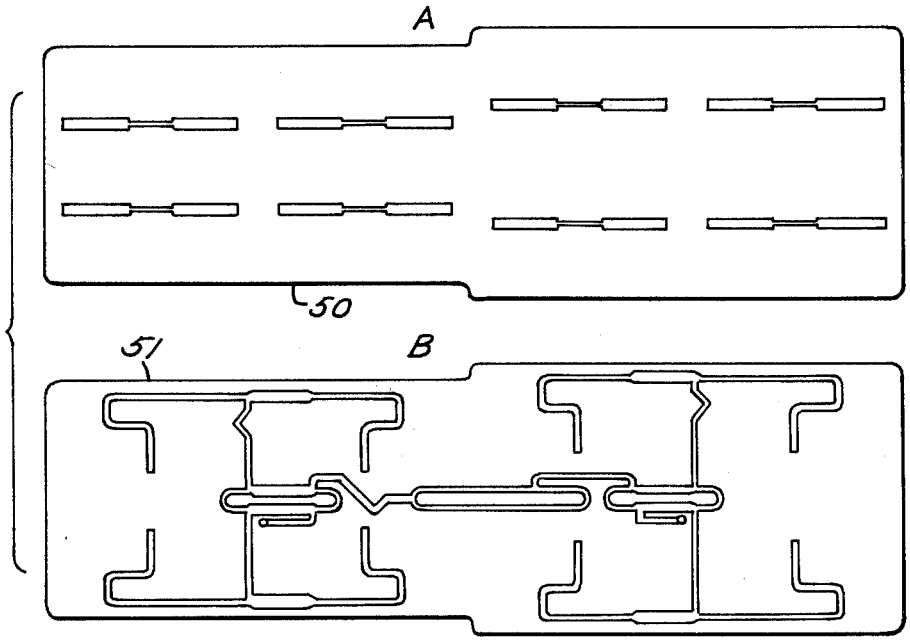
FIG. 7(*a*) is a plan view of the slot configuration in the upper circuit board of an antenna sandwich in accordance with an embodiment of this invention.
Figure 8:
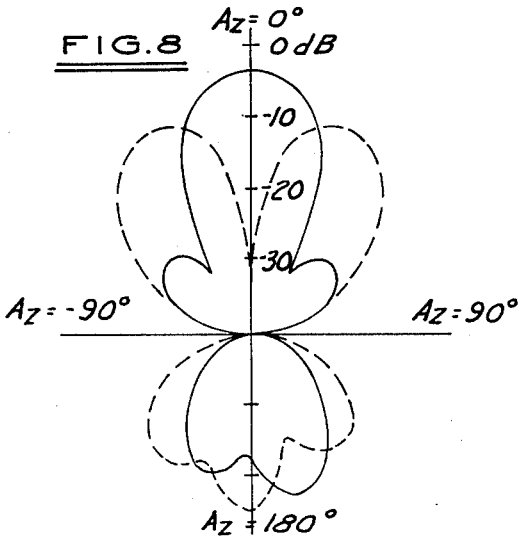
FIG. 8 is a graphical representation of the measured sum and difference azimuth patterns of an 8-slot asymmetrical endfire array in accordance with an embodiment of this invention.

In accordance with one embodiment of this invention shown in FIGS. 7*a* and 7*b*, and 8-slot asymmetrical array having a differential slot spacing of x=0.04 is fabricated of two one eighth inch thick printed upper and lower circuit boards 50 and 51 which are laminated together and bonded to a support structure (not shown). The 8-slots are etched in the top ground plane of the upper board 50 and the printed circuit feed network is etched in the top of the lower board 51. The printed circuit contains two 90° hybrids to form the endfire beams and a 180° hybrid to form the sum and difference azimuth beams. Impedance transformers within the circuit are designed to distribute power efficiently to the slots with a 3 dB amplitude taper across the array. Measured sum and difference azimuth patterns of the antenna are shown in FIG. 8. The leftward skew of the backlobe structure can be attributed to an amplitude unbalance between one or more pairs of fore and aft slots. A sidelobe-suppression-level of only 8 dB would eliminate all punch through in the measurement plane of these patterns.

Figure 9:
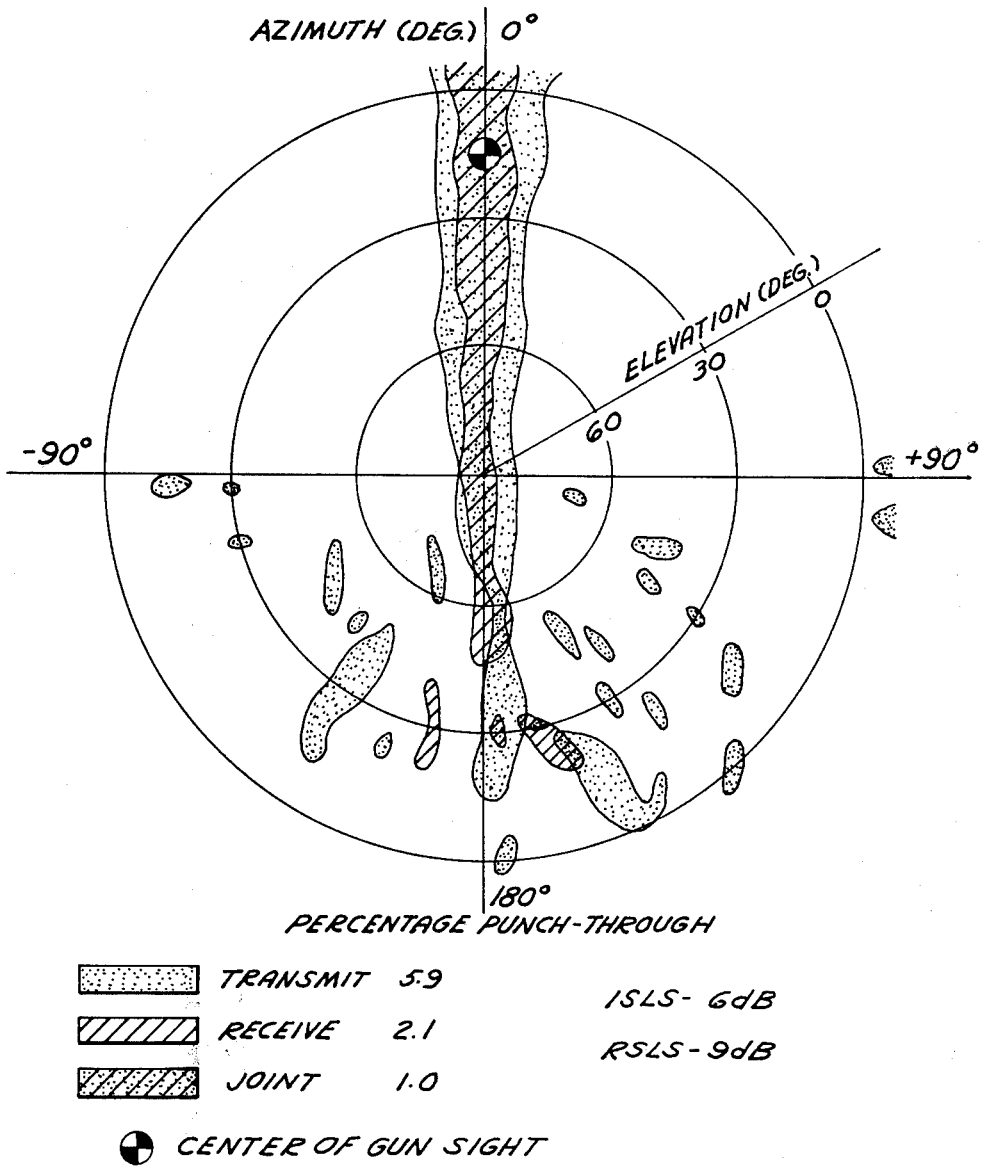

More than 3000 patterns were measured and analyzed to determine the performance of an antenna in accordance with an embodiment of this invention. Transmit punch through was evaluated at 1.03 GHz at a sidelobe-suppression-level of 6 dB and receive punch through was evaluated at 1.09 GHz at a sidelobe-suppression-level of 9 dB. Joint punch through was determined as the area in which both transmit and receive punch through occurred simultaneously. The punch through results were displayed on polar-projection maps as shown in FIG. 9. For the condition shown, joint punch through was one percent. The average joint punch through was only 0.34 percent based upon an equal probability of an interrogation anywhere within the volume of airspace below 30° elevation. Backlobe punch through was found to be well controlled and minimized by the unsymmetrical slot array geometry. Although backlobe structure was sensitive to amplitude unbalance with the array, punch through objectives were not compromised.

Figure 6:
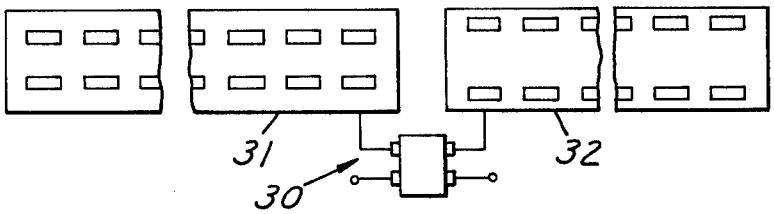
FIG. 6 is a partly block representation of an antenna system similar to FIG. 1 wherein there are n-pairs of radiators.

Referring to FIG. 6 an antenna system 30 is similar to antenna system 10 of FIG. 1 but has more than two dipoles in both a left hand array 31 and a right hand array 32. Spacing between adjacent dipoles in each of the arrays is equal, and the number of dipoles in one array is equal to the number of dipoles in the other array. Although FIG. 6 shows the dipoles aligned in two rows, the dipoles can also be arranged in a column so that additional dipoles are added in a fore and aft direction.

Various modifications and variations will no doubt occur to those skilled in the various art to which this invention pertains. All antenna systems of left and right arrays of radiators composed of one or more rows containing one or more elements per row with array geometry arranged so that the left and right arrays produce oppositely phased backlobes are considered to be within the scope of this invention. For example, the combining of one or more dipoles in one half of the array with one or more slots in the other half of the array will produce oppositely phased backlobes and is a variation which basically relies on the teachings of this invention. A particular configuration of achieving a radiating element such as a dipole or slot, may be varied from that disclosed herein. Such variations and all variations which basically rely on the teachings through which this disclosure has advanced the art are properly considered within the scope of this invention.

I claim:

1. An antenna system comprising:

a left antenna array having a first pair of radiating means for coupling electromagnetic energy thereby acting as antenna;

a right antenna array having a second pair of radiating means for coupling electromagnetic energy thereby acting as antenna;

a four hybrid coupler in communication with said left and right antenna arrays for forming sum and difference signals from signals associated with said left and right antenna arrays so that the difference signal has an aft directed backlobe peak greater in magnitude than the magnitude of the aft directed sum signal; and said first pair of radiating means having a spacing therebetween determined substantially by the equation, $\lambda(0.25-x)$ and said second pair of radiating means having a spacing therebetween determined substantially by the equation $\lambda(0.25+x)$, wherein $\lambda$ is the wavelength of an electrical signal applied to said antenna system and x is the radiating means spacing differential in wavelengths so that one of said antenna arrays produces a backlobe with a positive phase and the other of said antenna arrays produces a backlobe with a negative phase and combining of the signals associated with each of said antenna arrays in said four port hybrid coupler can produce said aft directed difference pattern peak simultaneously with a forward directed difference pattern null and said aft directed sum pattern null simultaneously with a forward directed sum pattern peak which can substantially eliminate sensitivity to the backlobes of said antenna system while sensitivity to the forward lobe is retained.

2. An antenna system as recited in claim 1 wherein each of said left and right antenna arrays contain more than one pair of radiating means, the number of pairs of radiating means in both said arrays being equal and the forward spacing between pairs of radiating means in the same array being equal.

3. An antenna system as recited in claim 1 wherein said radiating means are slots.

4. An antenna system as recited in claim 1 wherein said radiating means are dipoles.

5. An antenna system as recited in claim 1 wherein the value of x is less than about 0.25.

6. An antenna system as recited in claim 1 wherein:

said left antenna array includes two pairs of conductive slots, the slots in each pair being spaced $0.21\lambda$ from one another, wherein $\lambda$ is the wavelength of the electromagnetic energy associated with said antenna system;

said right antenna array includes two pairs of slots, the slots in each pair being spaced $0.29\lambda$ from one another; and said left and right antenna arrays being positioned side by side and said hybrid coupler is formed of wiring on a printed board adjacent to said left and right antenna arrays.

7. An apparatus as recited in claim 1 wherein said first and second arrays each include four slots of conductive material formed in a single plane, each of said slots being generally rectangular and positioned so as to have a longitudinal axis parallel to the longitudinal axis of the other of said slots, said first and second arrays being positioned side by side and said directional sensitivity pattern being established by spacing in a direction perpendicular to the side by side positioning of said first and second arrays.

8. An apparatus as recited in claim 7 wherein said coupler means for combining the sensitivity pattern of said first and second arrays includes a generally planar printed circuit board abutting the plane of said slots and includes, coupled to said first and second arrays, and further comprising two 90° hybrids to form an endfire beam and a 180° hybrid to form sum and difference beams.

9. An apparatus as recited in claim 1 wherein said coupler means and said first and second arrays being adapted so that the difference signal has an aft directed backlobe peak greater in magnitude than the magnitude of the aft directed sum signal.

* * * * *

UNITED STATES PATENT OFFICE

CERTIFICATE OF CORRECTION

PATENT NO. : 4,196,436

DATED : April 1, 1980

INVENTOR(S) : Charles W. Westerman

It is certified that error appears in the above-identified patent and that said Letters Patent are hereby corrected as shown below:

Assignee designation cancel "Ford Motor Company" and substitute --Ford Aerospace & Communications Corp.--

Signed and Sealed this

*Eighteenth* Day of *November 1980*

[SEAL]

*Attest:*

SIDNEY A. DIAMOND

*Attesting Officer*

*Commissioner of Patents and Trademarks*